United States Patent [19]

Ritsko et al.

[11] Patent Number: 4,900,587

[45] Date of Patent: Feb. 13, 1990

[54] METHOD FOR PRODUCING ALUMINUM OXIDE COATED IRON-ALUMINUM ALLOY POWDER

[75] Inventors: Joseph E. Ritsko, Towanda, Pa.; Walter A. Johnson, Houghton, Mich.; Nelson E. Kopatz, Sayre, Pa.

[73] Assignee: GTE Products Corporation, Stamford, Conn.

[21] Appl. No.: 292,714

[22] Filed: Jan. 3, 1989

[51] Int. Cl.[4] ..... B05D 7/00

[52] U.S. Cl. ..... 427/216; 427/224; 427/226; 427/377

[58] Field of Search ..... 427/216, 224, 377, 212, 427/226

[56] References Cited

U.S. PATENT DOCUMENTS 3,905,936 9/1975 Hawthorne ..... 427/216
4,507,262 3/1985 Karas et al. ..... 427/226
4,719,126 11/1988 Henery ..... 427/226

*Primary Examiner*—Stanley Silverman
*Attorney, Agent, or Firm*—Donald R. Castle; L. Rita Quatrini

[57] ABSTRACT

A method is disclosed for producing aluminum oxide coated iron-aluminum alloy powder which comprises contacting iron-aluminum alloy powder of fine particle size with a liquid aluminum compound wherein the aluminum is hydrolyzable and adding water to the compound and the iron-aluminum alloy powder to form a slurry, removing essentially all of the liquid from the slurry to produce iron-aluminum alloy powder with a coating of hydrolyzed aluminum oxide, and firing the iron-aluminum alloy powder with the hydrolyzed aluminum oxide coating in a non-oxidizing atmosphere to produce iron-aluminum alloy powder with a coating of aluminum oxide.

6 Claims, No Drawings

METHOD FOR PRODUCING ALUMINUM OXIDE COATED IRON-ALUMINUM ALLOY POWDER

This invention is related to application attorney's docket D-88-2-083 entitled "Method For Producing Aluminum Oxide Coated Iron Powder", and D-88-2-089, entitled "Method For Producing Aluminum Oxide Coated Cobalt Powder", both assigned to the same assignee as the present application and filed concurrently herewith.

BACKGROUND AND FIELD OF THE INVENTION

This invention relates to a method for producing a coating of aluminum oxide on iron-aluminum alloy powder by a slurry technique which is simple and inexpensive.

Iron-aluminum alloy powder coated with aluminum oxide is advantageous as a high temperature corrosion inhibitor.

SUMMARY OF THE INVENTION

In accordance with one aspect of the invention, there is provided a method for producing aluminum oxide coated iron-aluminum alloy powder which comprises contacting iron-aluminum alloy powder of fine particle size with a liquid aluminum compound wherein the aluminum is hydrolyzable and adding water to the compound and the iron-aluminum alloy powder to form a slurry, removing essentially all of the liquid from the slurry to produce iron-aluminum alloy powder with a coating of hydrolyzed aluminum oxide, and firing the iron-aluminum alloy powder with the hydrolyzed aluminum oxide coating in a non-oxidizing atmosphere to produce iron-aluminum alloy powder with a coating of aluminum oxide.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The present invention provides a method for forming a coating of aluminum oxide on fine iron-aluminum alloy powder particles which is simple and inexpensive.

The iron-aluminum alloy powder that is used is fine in size, that is, the particle size is normally no greater than about 10 micrometers in diameter. Most typically the iron-aluminum alloy powder contains from about 8% to about 20% by weight and preferably about 10% by weight aluminum.

The iron-aluminum alloy powder is contacted with a liquid aluminum compound wherein the aluminum is hyrdolyzable. Preferably aluminum alkoxides are used with aluminum tri-(sec-butoxide) being the especially preferred compound because it is liquid at room temperature and has a relatively high aluminum content. A preferred source of aluminum tri-(sec-butoxide) is manufactured by Chattem Drug & Chemical Company. Most preferably the amount of aluminum compound that is used is sufficient to result in an aluminum oxide content of from about 8% to about 10% and preferably about 9% by weight of the coated iron-aluminum alloy powder.

The iron-aluminum alloy powder and and the aluminum compound are preferably heated at no greater than about 90° C. to make the mixture more fluid.

Water is added to the iron-aluminum alloy powder and the aluminum compound to form a slurry and to hydrolyze the aluminum to aluminum hydroxide. The amount of water should be controlled to prevent washing the coating off the powder. Typical proportions of water, alloy and aluminum compound are given in the example that follows.

It is preferred to heat the slurry to accelerate the hydrolization process. However the temperature should not exceed about 90° C. because at higher temperatures the hydrolyzed aluminum compound hardens.

At this point essentially all of the liquid is removed from the slurry to leave iron-aluminum alloy powder with a coating of the hydrolyzed aluminum oxide. This is done most typically by evaporating the slurry to dryness.

The resulting dry powder of iron-aluminum alloy coated with hydrolyzed aluminum oxide is soft and is easily screened. It is preferred to screen the dry powder through an 80 mesh screen.

The resulting dry powder is then fired in a furnace in a non-oxidizing atmosphere at a sufficient temperature and for a sufficient time to decompose the hydrolyzed aluminum oxide to aluminum oxide and form a coating of aluminum oxide on the surfaces of the iron-aluminum alloy powder particles. The preferred temperature is from about 650° C. to about 800° C. and most preferably from about 700° C. to about 750° C. It is preferred that the temperature not go over about 800° C. because the metal can oxidize above this temperature. The preferred firing time is about ½ hour at these temperatures. The preferred non-oxidizing atmospheres are argon, hydrogen, nitrogen and mixtures thereof. The most preferred atmosphere is argon. Preferably the fired material is cooled in the non-oxidizing atmosphere before being removed from the furnace.

To more fully illustrate this invention, the following non-limiting example is presented.

Example

About 1200 g of iron-aluminum alloy containing about 10% by weight aluminum is added to about 500 ml of aluminum tri-(sec-butoxide) in a vycor tray. This mixture is heated to about 90° C. to make it more fluid. The mixture is stirred occasionally over a period of about ½ hour to insure that all iron-aluminum alloy particles are wetted with the aluminum compound. About 600 ml of deionized water are then added to the mixture and the resulting slurry is then stirred at a temperature of no greater than about 80° C. The slurry is then evaporated to dryness with agitation. The resulting dry powder is screened through an 80 mesh screen. The screened powder is then added to a small boat of about ¼ bed depth and fired in a furnace at from about 700° C. to about 750° C. for a period of about ½ hour in an atmosphere of argon, nitrogen or hydrogen. The powder is cooled in argon before being removed from the furnace.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for producing aluminum oxide coated iron-aluminum alloy powder, said method comprising:

(a) contacting iron-aluminum alloy powder of fine particle size with a liquid aluminum compound wherein the aluminum is hydrolyzable and adding water to said compound and said iron-aluminum alloy powder to form a slurry;

(b) removing essentially all of the liquid from said slurry to produce iron-aluminum alloy powder with a coating of hydrolyzed aluminum oxide; and (c) firing said iron-aluminum alloy powder with said hydrolyzed aluminum oxide coating in a non-oxidizing atmosphere to produce iron-aluminum alloy powder with a coating of aluminum oxide.

2. A method of claim 1 wherein said aluminum compound is an aluminum alkoxide.

3. A method of claim 2 wherein said aluminum compound is aluminum tri-(sec-butoxide).

4. A method of claim 1 wherein after said water is added to said slurry, said slurry is heated at a temperature of no greater than about 90° C.

5. A method of claim 1 wherein said non-oxidizing atmosphere is selected from the group consisting of argon, hydrogen, nitrogen, and mixtures thereof.

6. A method of claim 5 wherein said non-oxidizing atmosphere is argon.

* * * * *